United States Patent [19]

Haupenthal

[11] Patent Number: 4,848,230

[45] Date of Patent: Jul. 18, 1989

[54] REMOTELY CONTROLLABLE ADJUSTING MEANS FOR ELASTICALLY DEFORMING A REGISTER RAIL

[75] Inventor: Rudi Haupenthal, Epfenbach, Fed. Rep. of Germany

[73] Assignee: Heidelberger Druckmaschinen AG, Heidelberg, Fed. Rep. of Germany

[21] Appl. No.: 215,224

[22] Filed: Jul. 5, 1988

[30] Foreign Application Priority Data

Jul. 2, 1987 [DE] Fed. Rep. of Germany ..... 3721900

[51] Int. Cl.[4] ..... B41F 1/30; B41F 21/10; B41F 21/12

[52] U.S. Cl. ..... 101/409; 101/232

[58] Field of Search ..... 101/409, 410, 411, 412, 101/246, 232; 271/7, 82, 277

[56] References Cited

U.S. PATENT DOCUMENTS

| | | | |
|---|---|---|---|
| 3,417,696 | 12/1968 | Koch et al. | 101/409 |
| 3,682,472 | 8/1972 | Barthel | 101/409 X |
| 4,503,772 | 3/1985 | Urakawa et al. | 101/412 |

*Primary Examiner*—J. Reed Fisher

*Attorney, Agent, or Firm*—Herbert L. Lerner; Laurence A. Greenberg

[57] ABSTRACT

A remotely controllable adjusting device for elastically deforming a register rail in a substantially tangential direction of a sheet-guiding cylinder mounted in side walls of a sheet-fed printing machine, the sheet-guiding cylinder being preceded by a sheet-feeding device which accelerates the sheet to be printed to a speed greater than the peripheral speed of the sheet-guiding cylinder, and which brings the sheet into engagement with front guides of the register rail which is acted upon by the adjusting device operating against spring elements for elastically deforming the register rail includes a drive device arranged in the sheet-grinding cylinder and engaging deformingly with the register rail substantially in the longitudinal middle of the register rail, an axially adjustable profile rod having a first end for adjusting the drive device, the profile rod being disposed in the rotational center of the sheet-guiding cylinder, fixed against rotation relative to the cylinder, and having a second end accessible from outside a side wall of the printing machine, and adjusting elements arranged on the side wall for acting upon the second end of the profile rod outside the side wall for axially displacing the profile rod.

6 Claims, 2 Drawing Sheets

REMOTELY CONTROLLABLE ADJUSTING MEANS FOR ELASTICALLY DEFORMING A REGISTER RAIL

Figure 1:
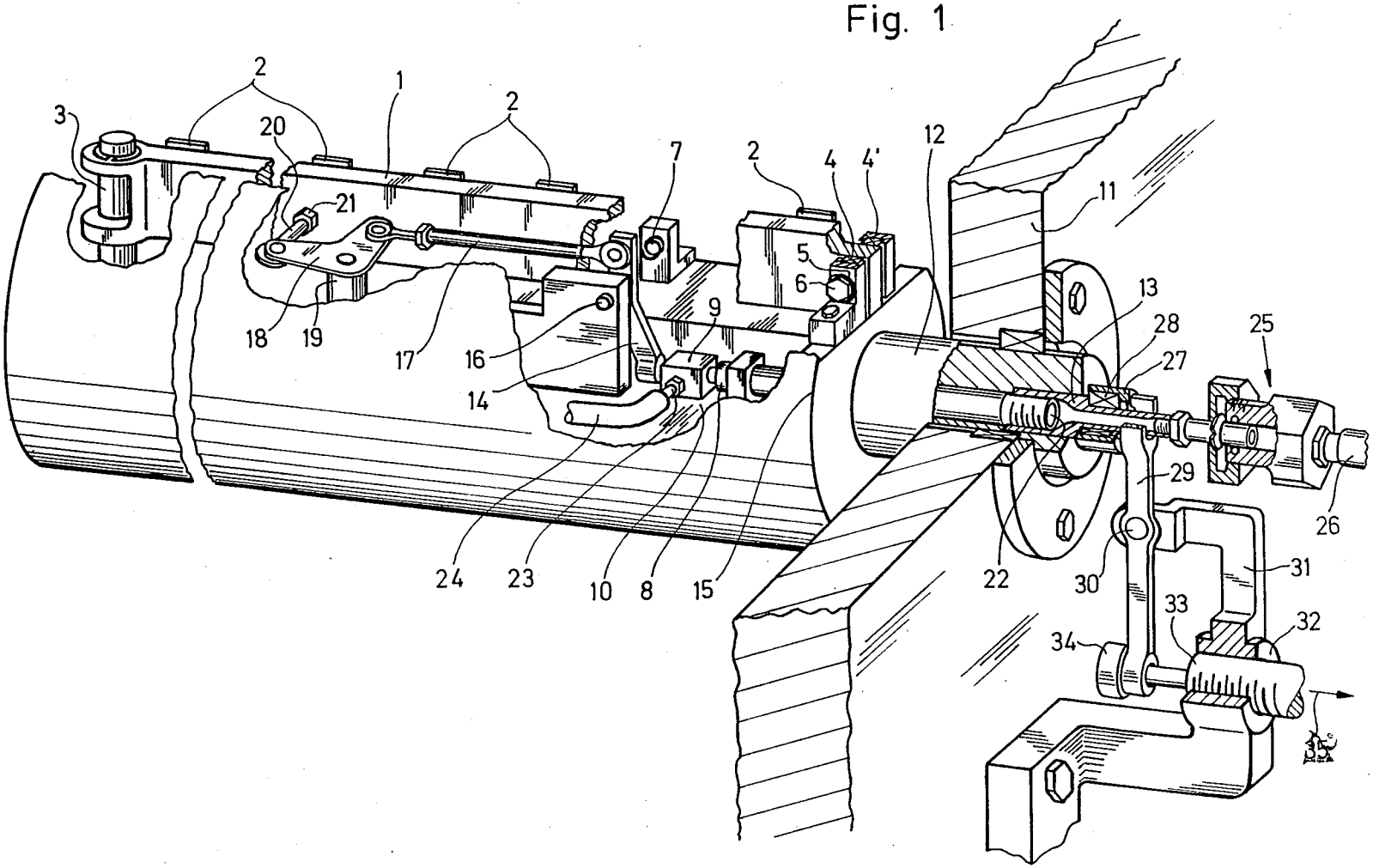

The invention relates to a remotely controllable adjusting means or device for elastically deforming a register rail, more particularly, in a substantially tangential direction of a sheet-guiding cylinder mounted in side walls of a sheet-fed printing machine, the sheet-guiding cylinder being preceded by a sheet-feeding device which accelerates the sheet to be printed to a speed greater than the peripheral speed of the sheet-guiding cylinder and which brings the sheet into engagement with front guides or lays of the register rail which is acted upon by the adjusting means operating against spring elements for elastically deforming the register rail.

Especially during the offset printing process, an amplified phenomenon occurs due to the use of dampening medium that the printed sheets are, in a manner of speaking, squeezed out by the printing-unit cylinders and thereby experience impermissible changes in dimensions for a multi-color printing, particularly, in vicinity of the trailing sheet end.

From the prior state of the art, conventional devices approach this problem, in comparing with the manner of operation of the sheet feeder systems and with the requirements for a registered multi-color printing, partly by a cyclic partly by a constant deformation of the leading edge of the sheet with the aim of equalizing or compensating the dimensions in vicinity of the trailing edge of the sheet. A suitable device, for constant deformation of the leading edge of the sheet has become known from German Published Non-Prosecuted Application (DE-OS) 35 04 435.

In this regard, the register rails of the first cylinder of a printing machine having stops for the leading edge of the sheet is bent essentially in circumferential direction of the cylinder by means of a respective setscrew at the ends and in the middle of the register rail. For engagement of the leading edge of the sheet against the front guides or lays of the bent register rail, the sheets are fed thereto preferably at a speed which is greater than the circumferential speed of the cylinder. To adjust the setscrews, an adjusting motor or servomotor is associated with each thereof. These motors are firmly mounted on the cylinder and keep pace with the rotary motion thereof so that slip ring contacts must be taken into consideration with respect to the supply of current thereto.

Starting from this state of the art, it is accordingly an object of the invention to provide an adjusting device of the foregoing general type which is remotely controllable without any servo-drive rotating with the cylinder.

With the foregoing and other objects in view, there is provided, in accordance with the invention, a remotely controllable adjusting device for elastically deforming a register rail in a substantially tangential direction of a sheet-guiding cylinder mounted in side walls of a sheet-fed printing machine, the sheet-guiding cylinder being preceded by a sheet-feeding device which accelerates the sheet to be printed to a speed greater than the peripheral speed of the sheet-guiding cylinder, and which brings the sheet into engagement with front guides of the register rail which is acted upon by the adjusting device operating against spring elements for elastically deforming the register rail, comprising drive means arranged in the sheet-guiding cylinder and engaging deformingly with the register rail substantially in the longitudinal middle of the register rail, an axially adjustable profile rod having a first end for adjusting the drive means, the profile rod being disposed in the rotational center of the sheet-guiding cylinder, fixed against rotation relative to the cylinder, and having a second end accessible from outside a side wall of the printing machine, and adjusting elements arranged on the side wall for acting upon the second end of the profile rod outside the side wall for axially displacing the profile rod.

The advantage achieved with the invention are especially that, due to dispensing with any need for a rotary servo-drive, the lines for supplying energy, for example, in the case of electromotive servo-drives, require no slip rings between a stationary power source and the load. Accordingly, the use of additional parts subject to wear can be dispensed with, and operational disruptions can thus be obviated. Advantageous possibilities of effecting adjustments during operation of the machine are maintained.

Moreover, the adjusting elements arranged on the side wall for acting upon the accessible second end of the profile rod outside the side wall are actuatable both by servomotor as well as manually so that various stages of the extent of automation of a printing machine incorporating the invention are attainable.

In accordance with another feature of the invention, the profile rod is formed with a longitudinal channel therethrough communicating with a frame-fixed grease-feed line at the second end of the profile rod accessible from outside the side wall, and with a grease line disposed in the sheet-guiding cylinder, at the first end of the profile rod.

In spite of a central introduction of force to bend the register rail, a grease feedline thereby extends to the rotating sheet-guiding cylinder, by means of which, for example, control rollers for the oscillating motion of a gripper shaft, which roll on stationary cams and rotate with the cylinder, can be supplied with grease.

In accordance with a further feature of the invention, the drive means is formed as a lever drive having two bellcranks linked to one another via a tension rod, the profile rod being formed as a plunger and being disposed in engagement with a first end portion of the drive means.

In accordance with an added feature of the invention, the adjusting elements for axially displacing the profile rod include a bellcrank having one arm operatively connected to the second end of the profile rod accessible from outside the side wall, and having its other arm operatively connected to an adjusting spindle. A sensitive bending of the register rail is thereby possible via the adjusting spindle.

In accordance with an additional feature of the invention, the one arm of the bellcrank operatively connected to the profile rod has a fork-shaped end which is engaged with the second end of the profile rod accessible from outside the side wall, through the intermediary of a thrust collar rotatably mounted with respect to the profile rod by means of a roller bearing. Thereby, a centric force introduction, which is markedly unimpaired by any adhesive and sliding friction effects, succeeds in applying a load with the adjusting forces for deforming the register rail without the coupling parts of the frame-fixed grease line.

For manually actuating the adjusting device, the adjusting spindle may be directly provided with a handwheel. The required manual forces are capable of being influenced especially via the lever-arm relationships or ratios of the lever drive arranged in the cylinder and of the lever formed with the fork-shaped end.

In accordance with a concomitant feature of the invention, the adjusting elements for axially displacing the profile rod include a frame-fixed spindle nut fastened coaxially to the sheet-guiding cylinder at the side wall, and a threaded sleeve guided in the spindle nut, the threaded sleeve having one end engaging the second end of the profile rod accessible from outside the side wall, and having another end carrying a ring gear, the ring gear being in meshing engagement with a gearwheel of a frame-fixed adjusting drive.

This further construction is especially suited for an automatic adjustment of the bending of the register rail during operation of the printing machine.

Other features which are considered as characteristic for the invention are set forth in the appended claims.

Although the invention is illustrated and described herein as embodied in a remotely controllable adjusting means for elastically deforming a register rail, it is nevertheless not intended to be limited to the details shown, since various modifications and structural changes may be made therein without departing from the spirit of the invention and within the scope and range of equivalents of the claims.

Figure 2:
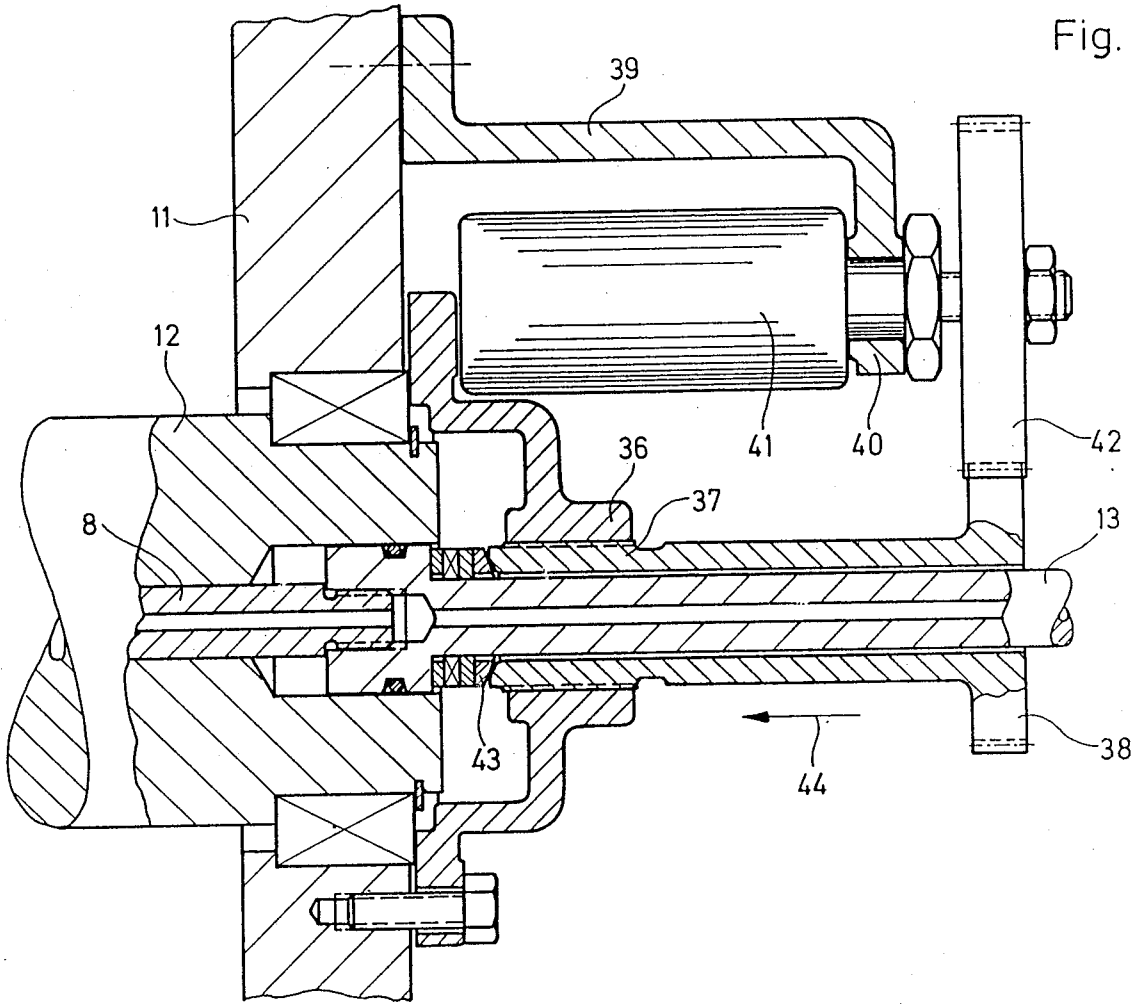

The construction and method of operation of the invention, however, together with additional objects and advantages thereof will be best understood from the following description of specific embodiments when read in connection with the accompanying drawings, in which:

FIG. 1 is a diagrammatic perspective view, partly broken away and partly in section, of a sheet-guiding cylinder with adjusting means according to the invention in a first embodiment of adjusting elements for axially shifting a profile rod, the adjusting elements being arranged on a side wall; and FIG. 2 is a simplified longitudinal sectional view of a second embodiment of the adjusting elements for axially shifting the profile rod.

Referring now to the drawing and first, particularly, to FIG. 1 thereof, there is shown a register bar 1 for stopping a leading edge of a sheet with front guides 2. For the purpose of bending the register rail substantially in circumferential direction of the register rail 1, the latter is provided with an eye at one end thereof and stuck thereby onto a radial pin 3 formed on a sheet-guiding cylinder, while the other end of the register rail is braced against the cylinder in both circumferential directions via a respective roller bearing 4,4'. The roller bearings 4 and 4', in turn are in engagement with the register bar 1 by means of a threaded connection 6 through the intermediary of a spring arrangement 5. The cylinder is studded along the register bar 1 with spring elements 7 which bias the register bar 1 in a direction opposing the compressive force exerted by the adjusting means on the register bar 1. With these spring elements 7, a double action is able to be achieved. For one, they permit the playfree installation of the adjusting means and, for another, bending of the register bar 1 in a direction opposite to the direction of action of the adjusting means is achieved therewith when these adjusting means are suitably adjusted and the spring characteristic is suitable.

A profile rod 8 is axially shiftably disposed in the center of rotation of the sheet-guiding cylinder, and is fixed against rotation relative to the cylinder. The inner end thereof is connected to a connecting block 9 fixed against rotation relative thereto, the connecting block 9 being braced by the underside thereof against a stop surface 10 of the sheet-guiding cylinder for protection against torsion. At the other end thereof, the profile rod 8 is guided in a central recess formed in a bearing pin 12 of the sheet-guiding cylinder mounted in the sidewall 11, the bearing pin 12 being shown broken away in FIG. 1, the profile rod 8 being lengthened by a sleeve 13 screwed thereon. This end of the profile rod 8 is accessible via this sleeve 13 from outside the side wall for the engagement therewith by adjusting elements which are described hereinafter.

These adjusting elements are constructed so that they exert a compressive force on the profile rod 8 in longitudinal direction of the latter. This compressive force is transmitted by the profile rod 8 to a lever drive for adjusting the latter. For this purpose, the end face of the connecting block 9 facing away from the profile rod 8 is engaged with one end of a first bellcrank or two-armed lever 14 of the lever drive. This lever 14 is arranged in the sheet-guiding cylinder pivotable by means of a pin 16 within the cylinder casing 15, and is linked by its other end to a tension rod 17 extending parallel to an axially parallel casing line of the cylinder casing 15. The tension rod 17 provides an articulating connection between the first lever 14 and a first arm of a second bellcrank or two-armed lever 18 of the lever drive. This lever 18 is likewise arranged in the sheet-guiding cylinder, pivotable within the cylinder casing by means of a pin 19, and transmits the axial displacements of the profile rod 8, in proportion to the lengths of the arms thereof and those of the first bellcrank 14, to a compression member 20 which on the one hand, is linked to the second arm of the bellcrank 18 and, on the other hand, is screwed into a side of the register rail 1 substantially in the middle thereof, and is secured by a counter or lock nut 21.

The profile rod 8 is thereby constructed as a compression rod and formed with a longitudinal channel 22. This longitudinal channel 22 communicates, at one end, with the connecting block 9 and a thread 23 formed therein for connecting a grease line 24 thereto and, at the other end, with a rotary lead-through 25 screwed into the outer end of the sleeve 13, a stationary grease feedline 26 being connected to the rotary lead-through 25.

In FIG. 1, there is, furthermore, shown a first embodiment of the adjusting elements for axially shifting or displacing the profile rod 8. A thrust collar 27 is thereby placed in contact with a shoulder of the sleeve 13 via a roller bearing 28. An outer end face of this thrust collar 27 is engaged by a fork-shaped end of an adjusting lever 29. The adjusting lever 29 is linked by a pin 30 to a holder or support 31 fastened to the side wall 11. The holder 31 is formed with an internally threaded eye 32 in which an adjusting spindle 33 is guided in parallel with the longitudinal axis of the sheet-guiding cylinder. The adjusting spindle 33 has an end by which it passes through the end of the adjusting lever 29 which is located opposite to the fork-shaped end thereof, and is provided with an adjusting ring 34 at the other side of the adjusting lever 29 through which it has passed.

In accordance with the manner of operation of the aforedescribed adjusting means, there occurs a bending of the register rail 1 directed towards the spring elements 7, by turning the adjusting spindle 33 so that it moves in the direction of the arrow 35 opposite the eye 32, which acts as a spindle nut. A moment turning the adjusting lever 29 to the left-hand side of FIG. 1 is thereby imparted to the adjusting lever 29 via the adjusting ring 34, so that the fork-shaped end of the adjusting lever 29 presses against the thrust collar 27 which, in turn, presses the profile rod 8 into the interior of the sheet-guiding cylinder. This axial movement of the profile rod 8 is then transmitted via the connecting block 9 to the lever drive, as described hereinbefore.

In FIG. 2, there is illustrated a second embodiment of the adjusting elements for axially displacing the profile rod 8. A frame-fixed spindle nut 36 coaxial with the sheet-guiding cylinder is fastened to the side wall 11, and the thrust collar 27 of FIG. 1 is replaced by a threaded sleeve 37 guided by the thread of the fixed spindle nut 36. The end of this threaded sleeve 37 facing towards the bearing pin 12 is engaged with a shoulder formed on the sleeve 13 (noted FIG. 1 also), while the other end of the threaded sleeve 37 is formed with a ring gear 38. A stirrup or bracket 39 is additionally fastened to the side wall 11. A drive motor 41 is flanged to an eye 40 formed on the stirrup or bracket 39. The motor 41 has a shaft passing through the eye 40 and carrying a gearwheel 42 which meshes with the ring gear 38.

To compensate for possible alignment errors, the end of the threaded sleeve 37 facing towards the bearing pin 12 is conically countersunk and is placed into engagement, via a spherical disc 43, with the sleeve 13.

In accordance with the manner of operation of this second embodiment of the adjusting elements, bending of the register rail directed towards the spring elements 7 (note FIG. 1 also) occurs as a result of turning the threaded sleeve 37 so that it is moved with respect to the spindle nut 36 in the direction of the arrow 44. The turning of the threaded sleeve 37 is accomplished with the aid of the drive motor 41 via the engagement or meshing of the gearwheel 42 with the ring gear 38. Because this gearwheel 42 also moves in the direction of the arrow 44, the driving gearwheel 42 is of wider construction than that of the ring gear 38.

I claim:

1. Remotely controllable adjusting device of elastically deforming a register rail in a substantially tangential direction of a sheet-guiding cylinder mounted in side walls of a sheet-fed printing machine, the sheet-guiding cylinder being preceded by a sheet-feeding device which accelerates the sheet to be printed to a speed greater than the peripheral speed of the sheet-guiding cylinder, and which brings the sheet into engagement with front guides of the register rail which is acted upon by the adjusting device operating against spring elements for elastically deforming the register rail, comprising drive means arranged in the sheet-guiding cylinder and engaging deformingly with the register rail substantially in the longitudinal middle of the register rail, an axially adjustable profile rod having a first end for adjusting said drive means, said profile rod being disposed in the rotational center of the sheet-guiding cylinder, fixed against rotation relative to the cylinder, and having a second end accessible from outside a side wall of the printing machine, and adjusting elements arranged on the side wall for acting upon said second end of said profile rod outside said side wall for axially displacing said profile rod.

2. Adjusting device according to claim 1 having a frame, and wherein said profile rod is formed with a longitudinal channel therethrough communicating with a grease-feed line at said second end of said profile rod accessible from outside the side wall, said grease-feed line being fixed to said frame, and with a grease line disposed in the sheet-guiding cylinder, at said first end of said profile.

3. Adjusting device according to claim 1, wherein said drive means is formed as a lever drive having two bellcranks linked to one another via a tension rod, said profile rod being formed as a plunger and being disposed in engagement with a first end portion of said drive means.

4. Adjusting device according to claim 1, wherein said adjusting elements for axially displacing said profile rod include a bellcrank having one arm operatively connected to said second end of said profile rod accessible from outside the side wall, and having its other arm operatively connected to an adjusting spindle.

5. Ajusting device according to claim 4, wherein said one arm of said bellcrank operatively connected to said profile rod has a fork-shaped end which is engaged with said second end of said profile rod accessible from outside the side wall, through the intermediary of a thrust collar rotatably mounted with respect to said profile rod by means of a roller bearing.

6. Adjusting device according to claim 1 having a frame, and wherein said adjusting elements for axially displacing said profile rod include a spindle nut fastened coaxially to the sheet-guiding cylinder at the side wall, said spindle nut being fixed to said frame, and a threaded sleeve guided in said spindle nut, said threaded sleeve having one end engaging said second end of said profile rod accessible from outside the side wall, and having another end carrying a ring gear, said ring gear being in meshing engagement with a gearwheel of an adjusting drive fixed to said frame.

* * * * *